US009676084B2

(12) United States Patent
Noel et al.

(10) Patent No.: US 9,676,084 B2
(45) Date of Patent: Jun. 13, 2017

(54) SCREWING/UNSCREWING TOOL FOR A SCREWING ELEMENT

(71) Applicants: Airbus SAS, Blagnac (FR); Airbus Operations GmbH, Hamburg (DE)

(72) Inventors: Mathieu Noel, Hamburg (DE); Eric Riviere, Merville (FR)

(73) Assignees: Airbus SAS, Blagnac (FR); Airbus Operations GmbH, Hamburg (DE)

( * ) Notice: Subject to any disclaimer, the term of this patent is extended or adjusted under 35 U.S.C. 154(b) by 325 days.

(21) Appl. No.: 14/608,824

(22) Filed: Jan. 29, 2015

(65) Prior Publication Data

US 2015/0209943 A1 Jul. 30, 2015

(30) Foreign Application Priority Data

Jan. 30, 2014 (FR) ..... 14 50747

(51) Int. Cl.

| | |
|---|---|
| ***B25B 17/02*** | (2006.01) |
| ***B25B 13/48*** | (2006.01) |
| ***B25B 17/00*** | (2006.01) |
| ***B25B 23/00*** | (2006.01) |

(52) U.S. Cl.

CPC ..... *B25B 17/02* (2013.01); *B25B 13/481* (2013.01); *B25B 17/00* (2013.01); *B25B 23/0078* (2013.01)

(58) Field of Classification Search

CPC ..... B25B 17/00; B25B 17/02; B25B 13/481; B25B 23/0078; B25B 23/0028; B25B 21/007

See application file for complete search history.

(56) References Cited

U.S. PATENT DOCUMENTS

| | | | |
|---|---|---|---|
| 2,510,483 | A | 6/1950 | Schnepel et al. |
| 3,828,629 | A | 8/1974 | Moore |
| 4,231,271 | A | 11/1980 | Yamada |

(Continued)

FOREIGN PATENT DOCUMENTS

| | | |
|---|---|---|
| EP | 2377650 | 10/2011 |
| GB | 1213378 | 11/1970 |

(Continued)

OTHER PUBLICATIONS

French Search Report, Oct. 7, 2014.

*Primary Examiner* — David B Thomas
(74) *Attorney, Agent, or Firm* — Greer, Burns & Crain Ltd.

(57) ABSTRACT

A tool to screw/unscrew a screwing element, having a module comprising a lever extending radially from and rotatable around a drive axis, a first transmission element rotatable around the drive axis by the lever, a transmission module comprising a second transmission element cooperating with the first element, a third transmission element rotatable around a screwing/unscrewing axis parallel to, and spaced from, the drive axis, a transmission system comprising an element transmitting the second element rotation to the third element, and an adapter with a fourth transmission element cooperating with the third element, and a cavity confirming to the screwing element. The tool includes a wedge with at least one rotatable adapter mounted thereon. The wedge comprises two support surfaces on planes parallel to the drive axis and disposed opposite one another to define a groove receiving an end of the transmission module on the third element side.

8 Claims, 2 Drawing Sheets

(56) References Cited

U.S. PATENT DOCUMENTS

| | | | | |
|---|---|---|---|---|
| 4,649,776 | A | 3/1987 | Puncochar | |
| 5,609,077 | A * | 3/1997 | Ohmi | B25B 13/481 81/467 |
| 9,095,960 | B2 * | 8/2015 | Kim | B25B 13/461 81/473 |
| 2009/0229421 | A1 | 9/2009 | Bass | |
| 2011/0252929 | A1 | 10/2011 | Ha | |
| 2013/0139651 | A1 * | 6/2013 | Taylor | B25B 21/00 81/57.22 |
| 2013/0233131 | A1 | 9/2013 | Badiali | |

FOREIGN PATENT DOCUMENTS

| | | |
|---|---|---|
| GB | 2056348 | 3/1981 |
| WO | 9952683 | 10/1999 |

* cited by examiner

SCREWING/UNSCREWING TOOL FOR A SCREWING ELEMENT

CROSS-REFERENCES TO RELATED APPLICATIONS

This application claims the benefit of the French patent application No. 1450747 filed on Jan. 30, 2014, the entire disclosures of which are incorporated herein by way of reference.

BACKGROUND OF THE INVENTION

The present invention relates to a screwing/unscrewing tool.

In order to screw/unscrew a screwing element, such as, for example, a screw or a nut, a technician conventionally uses a screwing/unscrewing tool, such as a spanner for example.

In a crowded environment, a tool of this type is not always appropriate, since the angular clearance of the tool is incompatible with the presence of the other components which constitute the environment of the screwing element, since the tool strikes against these components.

SUMMARY OF THE INVENTION

An objective of the present invention is to propose a screwing/unscrewing tool which does not have the disadvantages of the prior art, and which in particular makes it possible to screw/unscrew a screwing element which is disposed in a crowded environment.

For this purpose, a screwing/unscrewing tool is proposed which is designed to screw/unscrew a screwing element, and comprises:

- a screwing/unscrewing module comprising a lever which extends radially relative to a drive axis, and is mobile in rotation around the said drive axis, and a first transmission element which is rotated around the drive axis by the lever; and
- a transmission module comprising a second transmission element which is designed to cooperate with the first transmission element, a third transmission element which is mobile in rotation around a screwing/unscrewing axis parallel to, and spaced from, the drive axis, a transmission system comprising an element for transmission of the rotation of the second transmission element to the third transmission element, and an adapter with a fourth transmission element which is designed to cooperate with the third transmission element, and a cavity, the form of which is adapted to the screwing element, the tool being characterized in that it additionally comprises a wedge on which at least one adapter is mounted such as to be mobile in rotation, in that, for each adapter, the wedge comprises two support surfaces which are contained on planes parallel to the drive axis and are disposed opposite one another such as to define a groove which is designed to receive an end of the transmission module situated on the third transmission element side.

A tool of this type thus makes it possible to offset the drive axis from the screwing/unscrewing axis, and therefore facilitate access to the screwing element.

BRIEF DESCRIPTION OF THE DRAWINGS

The aforementioned characteristics of the invention, as well as others, will become more apparent from reading the following description of an embodiment, the said description being provided in relation with the appended drawings, in which.

DETAILED DESCRIPTION OF THE PREFERRED EMBODIMENTS

Figure 1:
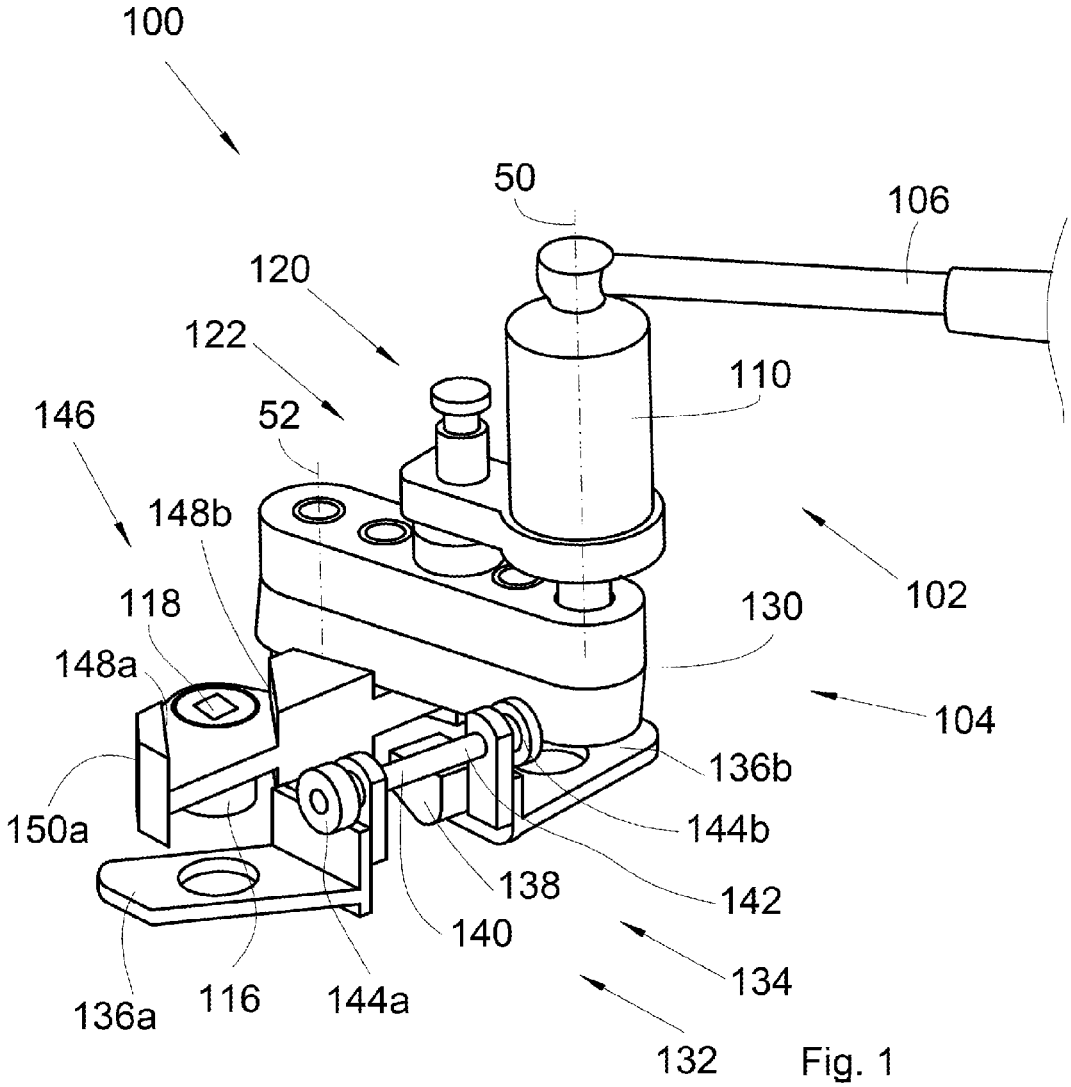
FIG. 1 shows a screwing/unscrewing tool according to the invention in the position of use.
Figure 2:
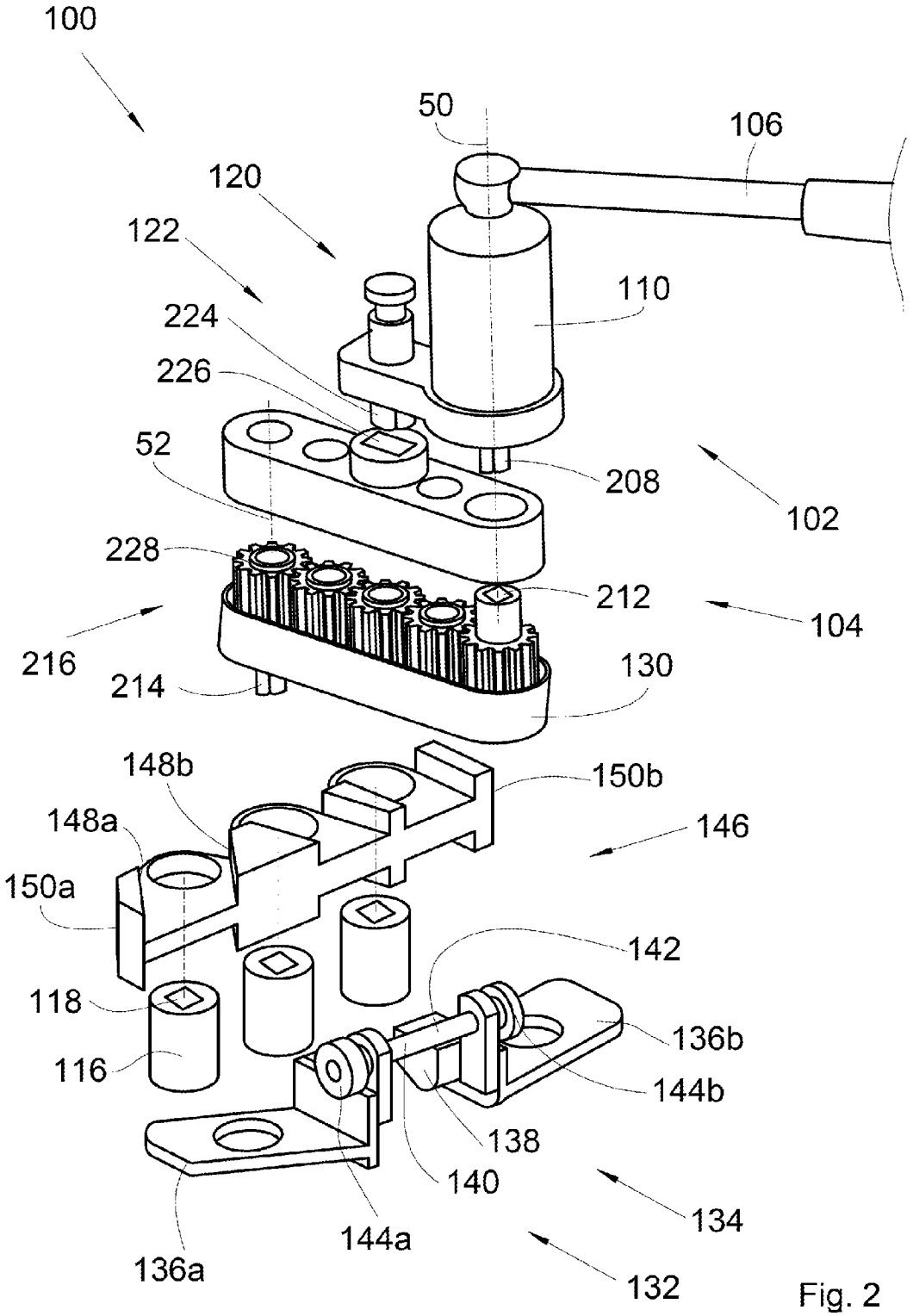
FIG. 2 shows the tool in FIG. 1 in exploded view.

FIG. 1 and FIG. 2 show a screwing/unscrewing tool 100 which is designed to screw/unscrew a screwing element, such as, for example, a screw or a nut.

The tool 100 comprises a screwing/unscrewing module 102 and a transmission module 104.

The screwing/unscrewing module 102 has a lever 106 which extends radially relative to a drive axis 50, and is mobile in rotation around the said drive axis 50 and a first transmission element 208, which is rotated around the drive axis 50 by the lever 106.

The transmission module 104 comprises a second transmission element 212, a third transmission element 214, a transmission system 216, and an adapter 116.

The second transmission element 212 constitutes the input of the transmission module 104. The second transmission element 212 cooperates with the first transmission element 208, and is thus rotated around the drive axis 50 by the latter.

The third transmission element 214 constitutes the output of the transmission module 104, and is mobile in rotation around a screwing/unscrewing axis 52, which is parallel to, and spaced from, the drive axis 50.

The transmission system 216 comprises elements to transmit the rotation of the second transmission element 212 to the third transmission element 214.

The adapter 116 has a fourth transmission element 118, which cooperates with the third transmission element 214, and is thus rotated around the screwing/unscrewing axis 52 by the latter.

The adapter 116 also has a cavity, the form of which is adapted to the screwing element to be screwed/unscrewed.

The rotation of the lever 106 will thus, by means of successive driving operations, rotate the adapter 116, which will screw/unscrew the screwing element.

The offsetting between the drive axis 50 and the screwing/unscrewing axis 52 makes it possible to space the lever 106 from the screwing element, and therefore to be clear from the crowded area around the screwing element.

The transmission module 104 has an elongate form, one of the ends of which is situated on the second transmission element 212 side, and the other end of which is situated on the third transmission element 214 side.

In order to obtain a substantial screwing torque at the level of the adapter 116 without needing to have a lever 106 with a long length, the screwing/unscrewing module 102 comprises a torque multiplier 110, which is placed between the lever 106 and the first transmission element 208. The torque multiplier 110 thus has an input which is driven by the lever 106, and an output which drives the first transmission element 208.

In this case, the first transmission element 208 is in the form of a male square, and in this case the second transmission element 212 is in the form of a female square, in which the first transmission element 208 fits.

In this case, the third transmission element 214 is in the form of a male square.

In this case, the adapter 116 is in the form of a bush, the fourth transmission element 118 of which is in the form of a female square in which the third transmission element 214 fits.

In order to block the rotation of the screwing/unscrewing module 102 relative to the transmission module 104 during the manipulation of the lever 106, the screwing/unscrewing module 102 has first blocking element 120 and the transmission module 104 has second blocking element 122. The first blocking element 120 and the second blocking element 122 are thus designed to cooperate together in order to block this rotation.

In this case the first blocking element 120 are in the form of a male element 224, and in this case the second blocking element 122 are in the form of a female element 226 in which the male element 224 fits. The male element 224 and the female element 226 have a longitudinal axis which is parallel to the drive axis 50, but is offset relative to the latter. It will be appreciated that it is possible to envisage that the first blocking element 120 take the form of a female element, and the second blocking element 122 take the form of a male element.

In the embodiment of the invention shown in FIG. 2, the transmission system 216 comprises a housing 130, on which the female element 226 is arranged, and a gear train 228, which is accommodated in the housing 130, and comprises a first gear 228 which is integral with the second transmission element 212, a final gear 228 which is integral with the third transmission element 214, and optionally at least one other gear 228 between the first gear 228 and the final gear 228. In this case, there are three gears 228 between the first gear 228 and the final gear 228.

Each gear 228 is mounted such as to be mobile in rotation in the housing 130 around its axis of rotation which is parallel to the drive axis 50.

According to a particularly advantageous embodiment, the lever 106 is in the form of a digital torque wrench which makes it possible to carry out screwing with precision of approximately 2%.

The torque multiplier 110 has for example a ratio of 22 between its input and its output.

In order to ensure the stability of the transmission module 104, the tool 100 comprises a support module 132 which has securing elements 134 and at least one support wing 136*a-b* integral with the securing elements 134.

The securing elements 134 are designed to secure the support module 132 on a surrounding fixed component (not represented in the figures). In the installation case in which an aircraft engine is secured to a strut, the surrounding fixed component is the engine support system known as a "BOOTSTRAP" in aeronautical jargon.

The or each support wing 136*a-b* makes it possible to support the transmission module 104, and more particularly the housing 130, when in use. The supporting of the transmission module 104 on the support wing 136*a-b* is carried out by the end which is situated on the second transmission element 212 side.

In this case, the securing elements 134 comprise two jaws 138, and a screwing system 140 which is designed to screw the jaws 138 against the fixed component. In this case, the screwing system 140 comprises a threaded rod 142 and two nuts 144 *a-b*. The two jaws 138 are fitted between the two nuts 144*a-b* on the threaded rod 142. Thus, the screwing of the nuts 144*a-b* will screw the jaws 138 on both sides of the fixed component.

In order to take up the screwing counter-torque at the level of the adapter 116, the tool 100 comprises a wedge 146 on which the said adapter 116 is fitted such as to be mobile in rotation. The wedge 146 comprises retention elements which are designed to prevent it from rotating around the screwing/unscrewing axis 52, and two support surfaces 148*a-b*.

The retention elements can comprise any appropriate elements. For example, they can be contact surfaces 150*a-b* which are supported against surrounding fixed components. According to the environment of the screwing element, the wedge 146 can thus have different forms.

Each of the two support surfaces 148*a-b* is contained on a plane parallel to the drive axis 50. The two support surfaces 148*a-b* are disposed opposite one another, and define a groove in which there is placed the transmission module 104, and more particularly the end of the transmission module 104 which is situated on the third transmission element 214 side. Thus, the rotation of the transmission module 104 is blocked by the two support surfaces 148*a-b* which are placed on both sides of the transmission module 104.

In order to carry out faster screwing/unscrewing when there is a plurality of adjacent screwing elements, the wedge 146 has an adapter 116 for each of the screwing elements, and the form of the wedge 146 is designed such that, when it is put into place, each adapter 116 is placed opposite the screwing element which it is designed to screw/unscrew. For each adapter 116, the wedge 146 comprises two support surfaces 148*a-b*.

Thus, the technician can screw/unscrew each screwing element without displacing the wedge 146, and by displacing only the screwing/unscrewing module 102 and the transmission module 104.

The wedge 146 thus comprises at least one adapter 116, and, for each adapter 116, two support surfaces 148*a-b*.

In the embodiment of the invention shown in FIGS. 1 and 2, the wedge 146 comprises three adapters 116, which correspond to three different screwing elements disposed adjacent to one another. When the wedge 146 with its adapters 116 and the support module 132 are put into place, the technician can place the screwing/unscrewing module 102 and the transmission module 104 in succession in the three positions which are defined by each pair of support surfaces 148*a-b*, such as to screw/unscrew each of the screwing elements.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A screwing/unscrewing tool configured to screw/unscrew a screwing element, which comprises:

a screwing/unscrewing module comprising a lever which extends radially relative to a drive axis, and is mobile in rotation around the said drive axis, and a first transmission element which is rotated around the drive axis by the lever;

a transmission module comprising a second transmission element which is designed to cooperate with the first transmission element, a third transmission element which is mobile in rotation around a screwing/unscrewing axis parallel to, and spaced from, the drive axis, a transmission system comprising an element for transmission of the rotation of the second transmission element to the third transmission element, and an adapter with a fourth transmission element which is designed to cooperate with the third transmission element, and a cavity, the form of which is adapted to the screwing element; and a wedge on which at least one adapter is mounted such as to be mobile in rotation, wherein, for each adapter, the wedge comprises two support surfaces which are contained on planes parallel to the drive axis and are disposed opposite one another such as to define a groove which is designed to receive an end of the transmission module situated on the third transmission element side.

2. The screwing/unscrewing tool according to claim 1, wherein the wedge comprises retention elements which are designed to prevent it from rotating around the screwing/unscrewing axis.

3. The screwing/unscrewing tool according to claim 1, wherein the screwing/unscrewing module comprises a torque multiplier with an input which is driven by the lever, and an output which drives the first transmission element.

4. The screwing/unscrewing tool according to claim 1, wherein the screwing/unscrewing module has first blocking element, in that the transmission module has second blocking element, and wherein the first and second blocking element are designed to cooperate together in order to block the rotation of the screwing/unscrewing module relative to the transmission module.

5. The screwing/unscrewing tool according to claim 4, wherein the first blocking element is in the form of one of a male and a female element, wherein the second blocking element is in the form of one of a female and a male element, in that the male and female elements have a longitudinal axis which is parallel to the drive axis and is offset relative to the latter, and in that the male element fits in the female element.

6. The screwing/unscrewing tool according to claim 1, wherein the transmission system comprises a housing and a gear train which is accommodated in the housing, and comprising a first gear which is integral with the second transmission element, a final gear which is integral with the third transmission element, each gear being mounted such as to be mobile in rotation in the housing around its axis of rotation which is parallel to the drive axis.

7. The screwing/unscrewing tool according to claim 6, further comprising at least one other gear between the first gear and the final gear, such at least one other gear being mounted such as to be mobile in rotation in the housing around its axis of rotation which is parallel to the drive axis.

8. The screwing/unscrewing tool according to claim 1, further comprising a support module with securing elements which are designed to secure the support module on a fixed component, and at least one support wing which is integral with the securing elements, and on which an end of the transmission module which is situated on the second transmission element side is supported.

* * * * *